US006951183B1

(12) United States Patent
Burback

(10) Patent No.: US 6,951,183 B1
(45) Date of Patent: Oct. 4, 2005

(54) MARINE ANCHOR RELEASE DEVICE

(76) Inventor: John Alexander Burback, 323 Copperfield Ct., Marco Island, FL (US) 34145

( * ) Notice: Subject to any disclaimer, the term of this patent is extended or adjusted under 35 U.S.C. 154(b) by 43 days.

(21) Appl. No.: 10/859,713

(22) Filed: Jun. 3, 2004

(51) Int. Cl.[7] ..... B63B 21/24
(52) U.S. Cl. ..... 114/297; 114/304
(58) Field of Search ..... 114/297, 298, 299, 114/304

(56) References Cited

U.S. PATENT DOCUMENTS

| | | | | | |
|---|---|---|---|---|---|
| 594,769 | A | * | 11/1897 | Ward | 114/298 |
| 2,816,522 | A | * | 12/1957 | Root | 114/299 |
| 4,114,554 | A | * | 9/1978 | Miller | 114/298 |
| RE31,654 | E | * | 8/1984 | Fasco | 114/297 |
| 4,644,894 | A | * | 2/1987 | Woodgate | 114/304 |
| 4,951,593 | A | * | 8/1990 | Brown et al. | 114/297 |
| 5,095,842 | A | * | 3/1992 | Soules | 114/299 |
| 5,474,015 | A | * | 12/1995 | Bruce | 114/294 |
| 6,038,996 | A | * | 3/2000 | Giles | 114/297 |

* cited by examiner

*Primary Examiner*—Stephen Avila
(74) *Attorney, Agent, or Firm*—Edward M. Livingston; Angela M. Miller; The Livingston Firm

(57) ABSTRACT

A marine anchor release mechanism that can be utilized on several pre-manufactured claw, plow or fluke type anchors for unsnagging the anchors from underwater obstructions. The release mechanism consists of two blade type brackets that run parallel to the shank of an anchor and connected to a rear portion of the anchor. A shear pin is installed through the parallel blade type brackets and the shank or an upper extension of the anchor that is sandwiched there between. The release mechanism is designed to release a snagged anchor by applying a sufficient force when powering the boat over the anchor, the shear pin will give way and the anchor assembly will rotate freely from an angle of substantially 180° with respect to the shackle end of the anchor, thus allowing the anchor to pull free from the obstruction.

4 Claims, 2 Drawing Sheets

MARINE ANCHOR RELEASE DEVICE

CROSS REFERENCE TO RELATED APPLICATIONS (none)

STATEMENT REGARDING FED SPONSORED R & D (none)

FIELD OF THE INVENTION

The invention relates to marine anchors that are manufactured without a release mechanism such as plow, spade or fluke anchors. This release mechanism or device is designed to be easily installed on new or existing anchors.

DESCRIPTION OF THE PRIOR ART

An anchor secures a boat to the bottom of a sea bed by weight of the anchor and by its design. However, typically when an anchor is set, it can become snagged with obstacles such as rocks, reef beds, vegetation or other structures. Often boaters are unable to free their anchors from the obstacles or obstructions and are forced to cut their anchor line, losing a section of the rope or chain and, of course, the anchor itself.

Various devices have been developed to change the attitude of the fluke or the plow of the anchor to a different position so that the plow can easily slip away or from under the position of the obstacle to free the same.

U.S. Pat. No. 5,095,842 illustrates such a device wherein a shear pin is used to resist a change of the position of the flukes on the anchor until it is completely snagged on an obstacle on the sea bed. The shear pin is installed on a supporting plate and must encounter a plate which is placed on and is rotating with the shaft supporting the flukes. This is totally different from the inventive concept of this invention.

U.S. Pat. No. 4,644,894 also discloses the use of at least two shear pins each located on plates that are attached to the anchor shaft. The relative inclination of the anchor body member and the anchor shaft member by applying a force greater than that required to effect a shearing of the shear pins so that the anchor shaft member can swing freely about the pivot with respect to the blade to allow a release of the anchor. This release mechanism is entirely different from the inventive device of this application.

U.S. Pat. No. 4,114,554 discloses a release mechanism that is not based on a use of shear pins but on over-center mechanism.

BACKGROUND OF THE INVENTION

A boat anchor is disclosed a fluke, spade or plow-type that will dig into the sea floor to anchor a boat to which it is attached by way of a line. Many times it happens that the anchor, especially the fluke will get attached to an object on the sea floor such as rocks or other items. It is almost impossible to free the anchor line resulting in a loss of the anchor.

BRIEF DESCRIPTION OF THE INVENTION

The inventive anchor includes a retrieval mechanism which consists of a two blade type bracket which blades run parallel to the shank of the anchor. The two blades and the shank of the anchor are pivoted relative to each other and are connected to each other at a point remote from the pivot point. The connection is made by way of a shear pin which shears or breaks at the time the anchor fluke cannot be dislodged from the sea floor and by powering the boat over the anchor enough force will be exerted on the shear pin to shear or break the same. This then which will change the locking position of the fluke to cause the same to stand upright and be freed from the obstacle.

BRIEF SUMMARY OF THE INVENTION

One of the main objects of this invention is the capability to install this device on pre-manufactured anchors and equipping them with a release capability in the event of snagging on the sea bed.

Another objective of this invention is the ease of installation with minimum equipment or tools.

It is yet another objective of this invention to provide such a device that is inexpensive to manufacture and maintain and to prevent the loss of expensive anchors and equipment.

DETAILED DESCRIPTION OF THE INVENTION

Figure 1:
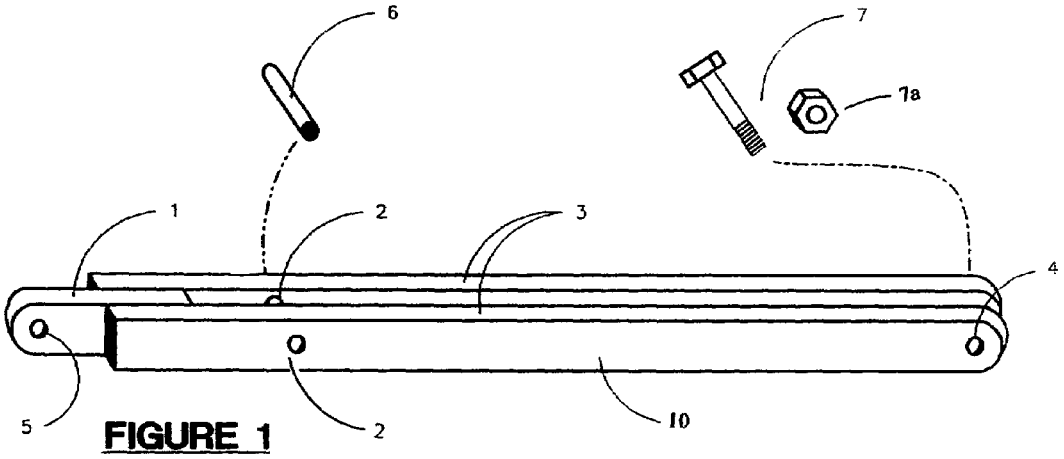
FIG. 1 represents a perspective view of the present invention with mounting hardware and shear pin.

Referring to FIG. 1, where the present invention is generally referred to with the numeral 10. It can be observed that it basically includes two blade assemblies 3 and a shackle end assembly 1. FIG. 1 also displays a shear pin guiding the same by phantom lines to openings 2 in the blade assemblies 3. There is also shown a bolt 7 with a nut 7*a* which leads be phantom lines into the openings 4 in the end which is remote from the shackle end assembly 1.

Figure 2:
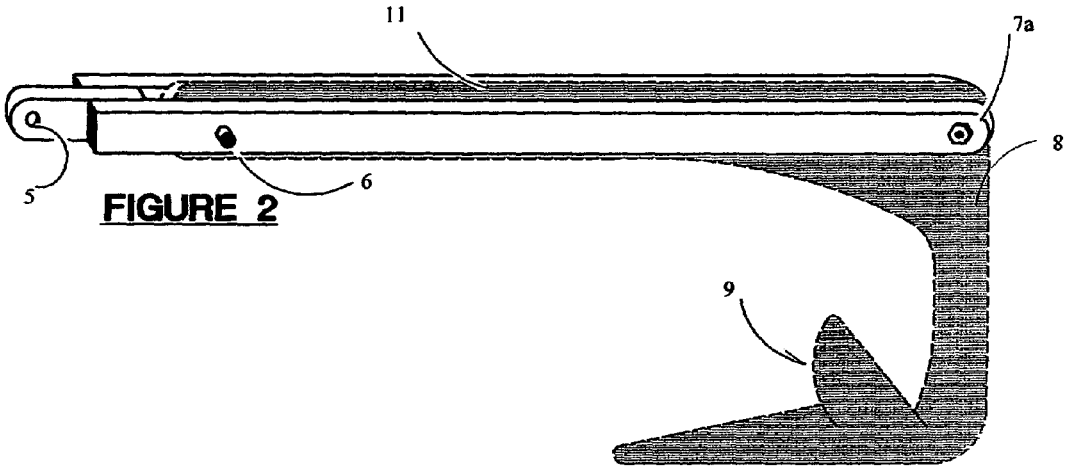
FIG. 2 is a perspective view of the invention installed on a pre-manufactured anchor.

Referring to FIG. 2, anchor 8 is manufactured by unspecified manufacturers. Invention 10 is designed to be utilized on numerous types and styles.

As seen in FIGS. 1 and 2, the fastening mechanism 7 and 7*a* is a common nut 7*a* and bolt 7 in sufficient length and size to fasten 10 to the anchor 8 through hole location 4 and the blades of 10 are held in place against rotation by the shear pin 6 at the hole location 2. The hole opening 5 in shackle end 1 is provided so that a rope or a chain can be secured to device 10. The anchor 8 has an upper longitudinal extension 11, which when the anchor is installed, will be sandwiched between the blade assembly 3 and parallel thereto. The upper longitudinal extension 11 is held from rotating around the pivot point 4 as long as the shear pin 6 remains in place. This then is the critical point of the invention. As soon as the shear pin is broken, the anchor 8 will rotate around the pivot point 4 to thereby change its attitude relative to the obstruction.

Figure 3B:
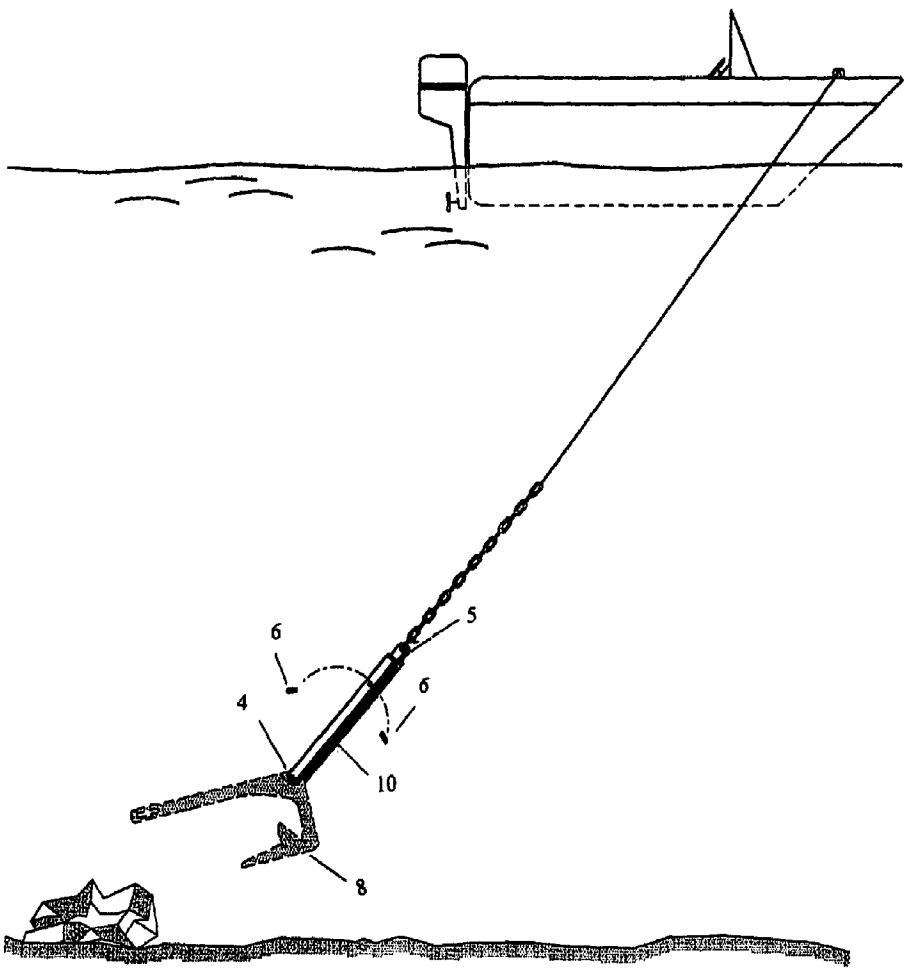
FIG. 3*b* illustrates an elevational side view of the invention releasing a snagged anchor from the underwater obstruction by the breaking away of a shear pin.
Figure 3A:
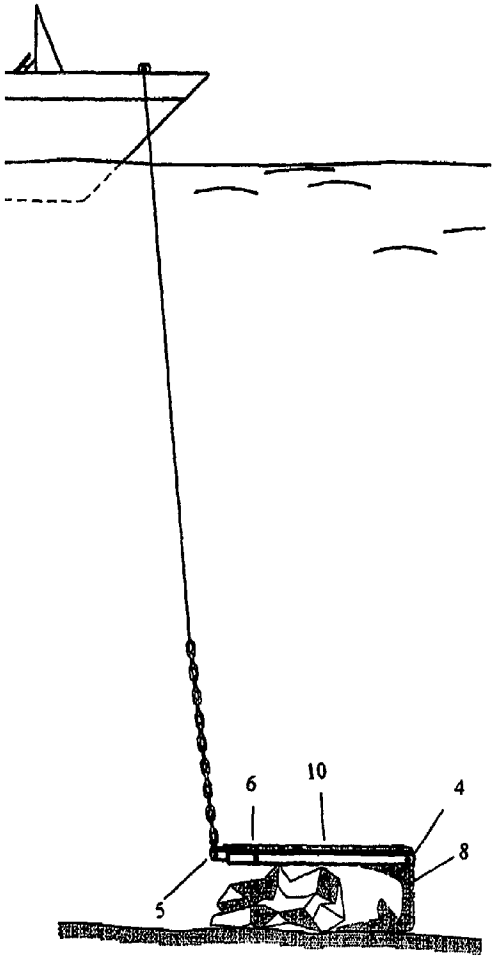
FIG. 3*a* illustrates an elevational side view of the invention installed on a pre-manufactured anchor being snagged on an underwater obstruction.

As can be seen in FIG. 3*a*, the boat is in position to pull anchor 8 and 10. The anchor 8 is illustrated as being snagged on an obstruction.

FIG. 3*b* illustrates the boat powering over and away from the snagged anchor 8 and 10 to thereby create a sufficient force to break the shear pin 6 to allow the invention 10 to rotate 180° away from the shackle end 1 of the anchor 8 and thereafter to pull freely from the obstruction because of a change in the orientation of the flukes 9 of anchor 8.

Upon retrieving the anchor 8 and the invention 10 or the overall assembly into the boat, the user will reposition the overall assembly back into place and merely install a new shear pin 6 into the opening 2 for continued use thereafter.

In the absence of shear pin 6 one can utilize a small rope or line to secure the overall assembly of the invention 10 by running the line through the openings 2 several times and securing the line in the openings 2. This will allow for continued use until a replacement shear pin becomes available.

What is claimed is:

1. An anchor release device adapted to be used on an anchor having an elongated shank containing a hole at a proximal end and a hole at a distal end and bottom engaging flukes angularly attached at the distal end, said device comprising:

two elongated blade-type brackets secured together and spaced apart a sufficient distance from each other to receive the shank of the anchor between said brackets;

said brackets having means at a proximal end for attachment to an anchor cable;

said brackets having a first set of holes near the proximal end aligned with the hole at the proximal end of the anchor shank;

said brackets having a shear pin for insertion through the first set of holes in the brackets and through the hole in the proximal end of the anchor shank sandwiched between said brackets;

said brackets having a second set of holes through a distal end of the brackets aligned with the hole in the distal end of the anchor shanks; and means for securing the distal end of the brackets to the distal end of the anchor shank through said second set of holes and the hole in the anchor shank sandwiched between the brackets;

whereby upon an excessive rotational force being applied to the proximal end of the brackets, said shear pin will break whereby said anchor will rotate around said distal end of the brackets to change the orientation of the anchor to the brackets.

2. The anchor release device of claim 1 wherein the means at the proximal end of the brackets for attaching the brackets to the anchor cable comprises:

a block secured between the brackets at the proximal end, said block extending beyond the proximal end of the brackets and having a hole therethrough for accepting an anchor shackle.

3. The anchor release device of claim 1 wherein the means for securing the distal ends of the brackets to the distal end of the anchor shank comprises:

a bolt having a threaded end for insertion through the second set of holes in the brackets and a hole in the distal end of the anchor shank; and a nut for threadable attachment to the threaded end of the bolt.

4. The anchor release device of claim 2 wherein the means for securing the distal ends of the brackets to the distal end of the anchor shank comprises:

a bolt having a threaded end for insertion through the second set of holes in the brackets and a hole in the distal end of the anchor shank; and a nut for threadable attachment to a threaded end of the bolt.

* * * * *